United States Patent [19]

Bellamy et al.

[11] 4,111,325

[45] Sep. 5, 1978

[54] SEALED CLOSURE FOR PLASTIC CONTAINER WITH INTERLOCKING PROTECTIVE OUTER CLOSURE

[75] Inventors: David Bellamy, Kenilworth, Ill.; David A. Winchell, Twin Lakes, Wis.

[73] Assignee: Baxter Travenol Laboratories, Inc., Deerfield, Ill.

[21] Appl. No.: 871,320

[22] Filed: Jan. 23, 1978

Related U.S. Application Data

[63] Continuation of Ser. No. 777,749, Mar. 14, 1977, abandoned.

[51] Int. Cl.[2] ..... B65D 41/32

[52] U.S. Cl. ..... 215/232; 215/253

[58] Field of Search ..... 215/232, 250, 251, 252, 215/253, 32, DIG. 3; 220/256, 266

[56] References Cited

U.S. PATENT DOCUMENTS 3,923,185 12/1975 Choksi ..... 215/232

*Primary Examiner*—Donald F. Norton

*Attorney, Agent, or Firm*—Paul C. Flattery; John P. Kirby, Jr.; George H. Gerstman

[57] ABSTRACT

A container for storing and dispensing sterile liquids is provided with a hermetically sealed primary cap and overcap. The overcap and primary cap are provided, respectively, with an interlocking ring and undercut lip to provide for limited relative axial movement; the overcap and bottle neck are provided with interfitting lugs and ribs to provide for limited rotational movement. An outer ring has internal threads engaging external threads on the overcap and defines a jacking member whereby rotation of the outer ring moves the overcap upwardly to break the hermetic seals.

11 Claims, 5 Drawing Figures

SEALED CLOSURE FOR PLASTIC CONTAINER WITH INTERLOCKING PROTECTIVE OUTER CLOSURE

This is a continuation of application Ser. No. 777,749, filed Mar. 14, 1977, now abandoned.

BACKGROUND OF THE INVENTION

Containers for storing and dispensing sterile liquids are known which have an inner or primary cap and an outer or overcap. Such containers are in common use for various medical and hospital procedures, such as the administration of irrigating solutions. An example of a prior art container is disclosed in Choksi U.S. Pat. No. 3,923,185.

Such sterile medical liquid containers have a common purpose of maintaining the sterility of their liquid contents during storage, shipping and dispensing. It is necessary that the closure system be easy for the nurse or physician to open, advantageously by the customary continuous counterclockwise rotation of the closure on the container.

The containers should be discarded after opening and use, and are commonly made of disposable thermoplastic material. Although the container disclosed in U.S. Pat. No. 3,923,185, mentioned above, may be discarded after opening and use, it is possible that it will be refilled and reused. By employing an internally threaded inner or primary cap which threadedly engages the externally threaded container neck, a nurse may reinstate the primary cap after refilling the container. Such refilling and reuse is generally considered undesirable and it is advantageous to have a disposable container system that prevents reuse instead of encouraging it.

Compressible materials, such as rubber, have frequently been used to provide the seals between the bottle and the closure; such compoundable materials form a mechanical seal which may be subjected to leaks as opposed to a welded or hermetic seal.

SUMMARY OF THE INVENTION

In accordance with the present invention, there is provided an improved container and closure system. The container includes a bottle having a bottle neck with a dispensing outlet. A primary cap is hermetically sealed as by fusing to the bottle neck. A frangible web or section is provided on the primary cap at the fused area. An overcap covers the primary cap and bottle neck and seats on a transverse abutment means on the bottle surrounding the outlet. The overcap is hermetically sealed as by fusing to the bottle at the abutment and defines a frangible web or section at the fused area. An interlocking ring and undercut lip are formed on the overcap and primary cap to limit relative axial movement thereof. Interfitting holding lugs and holding ribs are provided on the bottle neck and overcap for limiting relative rotational movement thereof. An outer ring is provided over the overcap and is threadingly interconnected therewith.

In operation, the rotation of the outer ring serves as a screw jack, downward movement being restricted by the abutment so as to drive the overcap upwardly to fracture the frangible section thereof. Rotation of the overcap is limited by the interlocking holding lugs and holding ribs. Continued rotation of the outer ring fractures the frangible section of the primary cap through engagement of the interfitting ring with the undercut lip.

The closure is tamperproof; both the primary cap and the overcap are fused to the bottle neck so that the seals must be fractured to remove the caps and tampering is easily detected. The closure is non-reusable; after the seals are broken the closure cannot be refastened to the bottle. Moreover, the closure has improved integrity; both the primary cap and overcap are hermetically sealed by fusing to the bottle neck.

No reliance is placed on compressed material to form a seal; thus there is an all plastic container. The all plastic container is very economical, providing an inexpensive disposable unit.

A more detailed explanation of the invention is providing in the following description and claims and is illustrated in the accompanying drawings. BRIEF DESCRIPTION OF THE DRAWINGS FIG. 1 is an elevational view of a container according to the present invention;

DETAILED DESCRIPTION OF THE ILLUSTRATIVE EMBODIMENT

Figure 1:
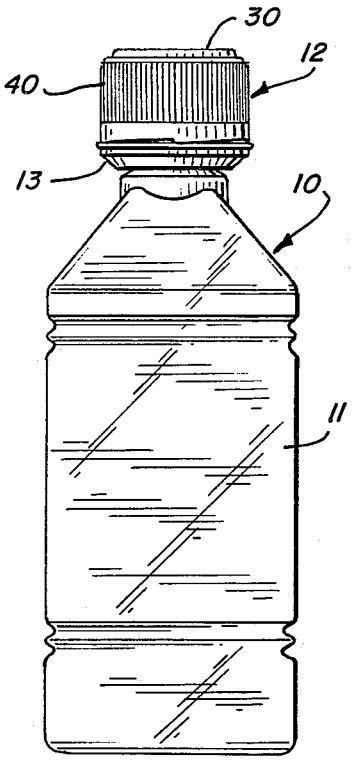
Figure 4:
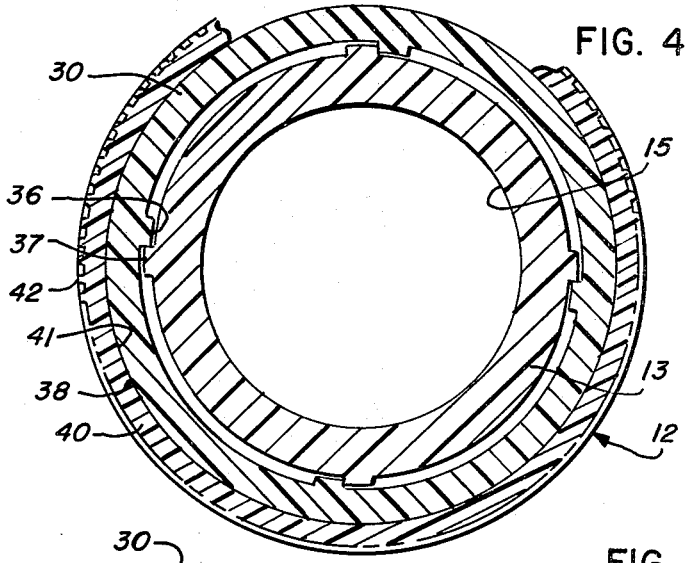
FIG. 4 is a cross-sectional plan view of the closure of FIG. 1, taken along line 4—4 of FIG. 2.

Referring to the drawings, there is illustrated a thermoplastic container 10 (FIG. 1) including a thermoplastic bottle 11 and a thermoplastic closure system 12, contained on a bottle neck 13 of the bottle 11. This container 10 contains sterile medical liquids, such as normal saline, sterile water and the like, commonly supplied to hospitals. In the illustrative embodiment, the container has a dispensing outlet 15 extending through the bottle neck 13. The bottle neck terminates in a pouring lip 16. The pouring lip 16 defines an annular groove or seat 17 on the bottle neck 13.

Figure 5:
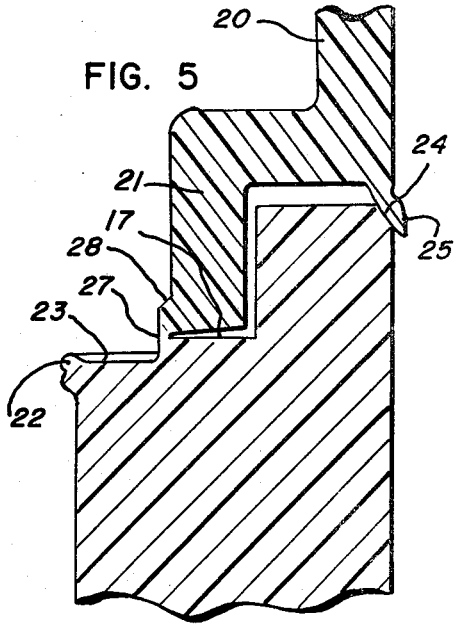
FIG. 5 is an enlarged fragmentary cross-sectional view illustrating a typical fused seal according to the present invention.

Hermetically sealing off the bottle neck 13 and lip 16 is an inner or primary cap 20 formed of thermoplastic material of generally disc shape and is initially provided with a downwardly depending annular rib 21 terminating with an annular radially extending flange (not shown). The primary cap 20 is hermetically sealed by fusion to the bottle neck, and in the illustrative embodiment best illustrated in FIG. 5, the radially extending flange has been removed from rib 21 and has been forced into an annular bead 22 as a result of downward heat and pressure, which also forms a depression 23 around seat 17. A frangible web or section 27 is thus formed normal to the seat 17 with frangible section 27 forming the vertical side wall of the depression 23. The fracture of the frangible section 27 will occur in tension.

A chamfer 28 is provided adjacent the frangible section 27. A second hermetic pressure seal is defined between an interfering wedge-shaped annular bevel 24 formed on the inner upper edge of the bottle neck and an annular lip 25 formed on the primary cap 20. The primary cap is also provided with a circumferentially defined undercut lip 26.

Hermetically covering the primary cap 20 and bottle neck 13 is an outer or overcap 30, formed of thermoplastic material, of generally inverted cup-shape and is initially formed with an annular radially outwardly extending flange (not shown) positioned on an abutment 32 of the bottle neck 13. The overcap 30 is fused to the bottle neck in like manner as the primary cap 20. In the illustrative embodiment, the radially extending flange has been removed from the overcap and has been forced into an annular bead 31 as a result of downward heat and pressure, which also forms a depression 39 around the top surface of abutment 32. A frangible web or section 33 is thus formed normal to the abutment 32, with frangible section 33 forming the vertical side wall of the depression 39. This heat seal is similar to the heat seal of the primary cap, illustrated in FIG. 5. The fracture of the frangible section 33 will occur in tension. A chamfer 43 is provided adjacent the frangible section 33.

The overcap 30 is provided with a radially inwardly extending locking ring 35 interfit into the undercut lip 26 of the primary cap 20 to limit relative axial movement between the primary cap 20 and the overcap 30. The inner cylindrical surface of the overcap is provided with axially extending, inwardly projecting holding lugs 36 interfitted between axially extending outwardly projecting holding ribs 37 formed on the bottle neck to limit relative rotational movement between the overcap and the bottle neck. The overcap 30 is provided with external threads 38, shown as left-hand threads.

An outer ring 40 is positioned over the cap 30 and is provided with complementary internal left-hand threads 41 operatively associated with the threads 38 on the overcap. The ring 40 may contain knurling or serrations 42 to assist in holding and turning the ring. The outer ring 40 bears within the depression 39 in the abutment 32 on the bottle neck 13 to define a screw jacking member.

Figure 2:
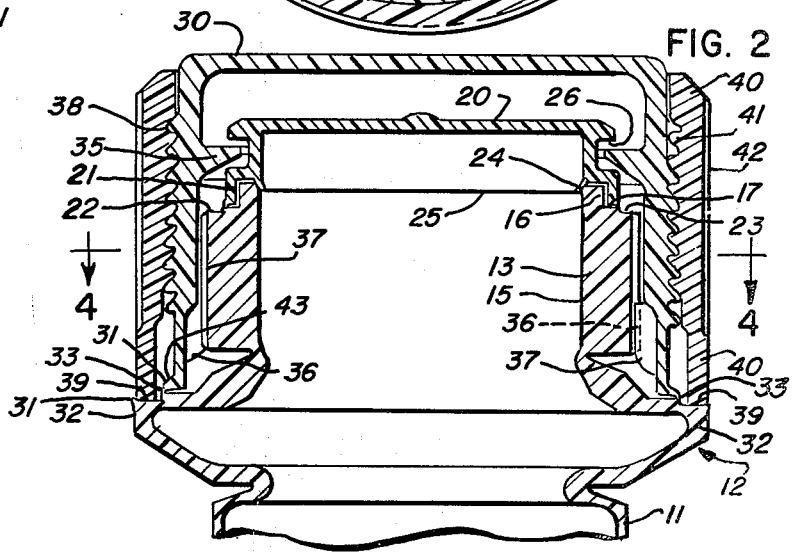
FIG. 2 is a fragmentary cross-sectional view of the container of FIG. 1 illustrating the closure to a larger scale and shown in the sealed position.

From the above brief description, the operation of the container is believed clear. However, briefly, it will be understood that the contents of the container 10 are sealed by three seals between the bottle neck 13 and the closure system 12, as illustrated in FIG. 2. The entire bottle neck and primary cap 20 are enclosed by the overcap 30 heat sealed or fused to the bottle neck 13.

Figure 3:
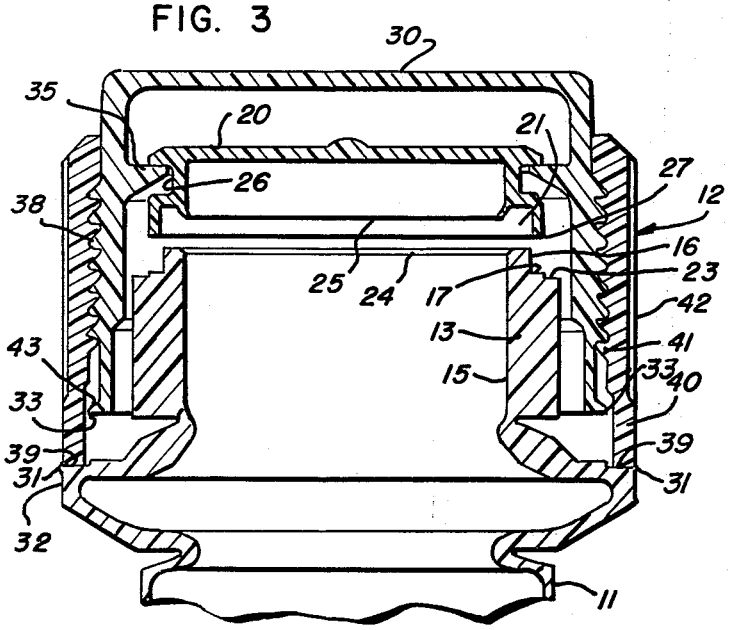
FIG. 3 is a fragmentary cross-sectional view of the container as illustrated in FIG. 2, but shown with the closure loosened on the bottle neck.

Rotation of the outer ring in a conventional counterclockwise direction with a continuous rotation removes the closure system 12. Initial rotation of the outer ring 40 bears against the abutment 32 to jack the overcap 30 axially upwardly, as illustrated in FIG. 3, fracturing the frangible section 33 by tensile force. Continued rotation of the outer ring 40 jacks the overcap 30 upwardly so that the locking ring 35 engages the primary cap 20 and raises the primary cap, also as illustrated in FIG. 3, so as to fracture the frangible section 27 by tensile force. The closure 12 is now loose on the bottle neck and can be removed. Once the seals on the closure 12 have been broken, the bottle cannot be reclosed.

Advantageously the fused seals 27 and 33 for the primary cap 20 and overcap 30 are readily fractured with a minimum of jacking force, the fractures occurring in tension as shown in FIG. 3, normal to the seat 17 and abutment 32. The vertical webs of the seals 27 and 33 are more easily frangible, and are less likely to hang up than other known seals.

Although an illustrative embodiment of the invention has been shown and described, it is to be understood that various modifications and substitutions may be made by those skilled in the art without departing from the novel spirit and scope of the present invention.

What is claimed is:

1. An improvement in a container having a hermetically sealed primary cap and overcap for storing and dispensing sterile liquids, which includes a thermoplastic bottle with a dispensing outlet, said bottle and overcap forming a unit that has a transverse abutment means surrounding the outlet, said improvement comprising, in combination: a bottle neck with a pouring lip surrounding the dispensing outlet; a primary cap including a top wall and an area hermetically fused to said bottle neck closing the dispensing outlet and having a thin frangible section at said fused area; an overcap covering said primary cap and bottle neck and having an area hermetically fused to said container proximate said abutment means and provided with a thin frangible section at said fused area; an outer ring over said overcap and overlying said transverse abutment means; interlocking means interconnecting said primary cap and said overcap limiting relative axial movement thereof, whereby upward axial movement of said overcap will jack said primary cap off said bottle neck; interlocking means interconnecting said overcap and said bottle neck limiting relative rotational movement thereof; and jacking means interconnecting said outer ring and said overcap, whereby rotation of said outer ring against said transverse abutment means moves said overcap axially upwardly to sever said frangible sections.

2. An improvement in a container having a hermetically sealed primary cap and overcap for storing and dispensing sterile liquids, which includes a thermoplastic bottle with a dispensing outlet, and said bottle and overcap forming a unit that has a transverse abutment means surrounding the outlet, said improvement comprising, in combination: a bottle neck with a pouring lip surrounding the dispensing outlet; a primary cap including a top wall and having an area hermetically fused to said bottle neck closing the dispensing outlet and having a frangible section at said fused area; an overcap covering said primary cap and said bottle neck and having an area hermetically fused to said container at said abutment means forming a thin frangible section; said overcap and said primary cap having interlocking means for limiting relative axial movement thereof; said overcap and said bottle neck having interlocking means for limiting relative rotational movement thereof; said overcap having external threads; and an outer ring over said overcap having internal threads engaging said external threads and overlying said transverse abutment means, whereby rotation of said outer ring against said transverse abutment means moves said overcap axially upwardly to sever said frangible sections.

3. The improvement as set forth in claim 2 above, wherein said interlocking means for limiting relative axial movement includes an interlocking ring and undercut lip on said primary cap and overcap.

4. The improvement as set forth in claim 2 above, wherein said interlocking means for limiting relative rotational movement includes interfitting holding lugs and holding ribs on the confronting surfaces between said overcap and said bottle neck.

5. The improvement as set forth in claim 2, wherein said threads are left-handed.

6. The improvement as set forth in claim 2, wherein said primary cap and said bottle neck are provided with an interfering wedge-shaped annular bevel and lip defining an inner seal.

7. The improvement as set forth in claim 2, wherein said frangible sections each comprise a vertical web frangible in tension during a jacking rotation of said outer ring.

8. The improvement as set forth in claim 2, wherein counterclockwise rotation of said outer ring abuts said outer ring against said abutment means and drives said overcap axially upwardly driving said primary cap axially upwardly from said bottle neck fracturing both said frangible webs in tension.

9. An improvement in a container having a hermetically sealed primary cap and overcap for storing and dispensing sterile liquids, which includes a bottle with a dispensing outlet, and said bottle and overcap forming a unit that has a transverse abutment means surrounding the outlet, said improvement comprising, in combination: a bottle neck with a pouring lip surrounding the dispensing outlet; a primary cap including a top wall and an area hermetically sealed to said bottle neck closing the dispensing outlet; an overcap covering said primary cap and bottle neck and having an area hermetically sealed to said container; said overcap and said primary cap having an interlocking ring and undercut lip for limiting relative axial movement thereof, whereby upward axial movement of said overcap will jack said primary cap off said bottle neck; said overcap and said bottle neck having interfitting holding lugs and holding ribs on the confronting surfaces between said overcap and said bottle neck for limiting relative rotational movement thereof; said overcap having left-handed external threads; and an outer ring over said overcap having internal threads engaging said external threads, whereby rotation of said outer ring moves said overcap axially upwardly to remove both said primary cap and said overcap.

10. The improvement as set forth in claim 9, in which said hermetic seals comprise heat fused seals defining vertical webs frangible in tension during upward axial movement of said overcap.

11. The improvement as set forth in claim 10, wherein said primary cap and said bottle neck are provided with an interfering wedge-shaped annular bevel and lip defining an inner seal.

* * * * *